US011532445B1

(12) United States Patent
Zhu et al.

(10) Patent No.: US 11,532,445 B1
(45) Date of Patent: Dec. 20, 2022

(54) KEY STRUCTURE

(71) Applicant: Primax Electronics Ltd., Taipei (TW)

(72) Inventors: De-Guang Zhu, Taipei (TW); Rong-Biao Xu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/510,059

(22) Filed: Oct. 25, 2021

(30) Foreign Application Priority Data

Sep. 6, 2021 (CN) ..... 202111037589.9

(51) Int. Cl.
*H01H 13/14* (2006.01)
*H01H 13/04* (2006.01)
*H01H 13/20* (2006.01)

(52) U.S. Cl.
CPC ..... *H01H 13/14* (2013.01); *H01H 13/04* (2013.01); *H01H 13/20* (2013.01); *H01H 2233/07* (2013.01)

(58) Field of Classification Search
CPC ..... H01H 13/14; H01H 13/04; H01H 13/20; H01H 2233/07; H01H 3/125; H01H 13/7065; H01H 3/12; H01H 13/70
See application file for complete search history.

(56) References Cited

U.S. PATENT DOCUMENTS 8,829,377 B2 * 9/2014 Khor ..... H01H 3/125 200/344
9,000,313 B2 * 4/2015 Pan ..... H01H 3/125 200/344
2019/0206634 A1 * 7/2019 Chang ..... H01H 13/12

* cited by examiner

*Primary Examiner* — Lheiren Mae A Caroc
(74) *Attorney, Agent, or Firm* — Kirton McConkie; Evan R. Witt

(57) ABSTRACT

A key structure includes a keycap, a base plate and a supporting element. The supporting element includes a first frame and a second frame. The supporting element is connected with the keycap and the base plate. Consequently, the keycap is movable upwardly or downwardly relative to the base plate. When the first frame and a second frame are combined together, a first span and a second span are formed sequentially. The second span is smaller than the first frame.

13 Claims, 8 Drawing Sheets

KEY STRUCTURE

FIELD OF THE INVENTION

The present invention relates to the structure of an input device, and more particularly to a key structure.

BACKGROUND OF THE INVENTION

In modern societies, electronic products become indispensable parts in human lives. The electronic products are applied in many sectors, including food, clothing, housing, transportation, education and entertainment. Generally, the electronic product is equipped with a keyboard for facilitating the user to input control signals.

FIG. 1 is a schematic exploded view illustrating a conventional key structure. As shown in FIG. 1, the conventional key structure 9 comprises a keycap 90, a supporting element 91 and a base plate 92. The supporting element 91 is a scissors-type ascending/descending mechanism comprising two frames 911 and 912. The two frames 911 and 912 can be swung relative to each other. A first end 9111 of the frame 911 and a third end 9121 of the frame 912 are connected with the keycap 90. A second end 9112 of the frame 911 and a fourth end 9122 of the frame 912 are connected with the connecting parts 921 and 922 of the base plate 92, respectively.

During the process of assembling the key structure 9, there is a fixed span ds between the two ends of the frames 911 and 912 (i.e., the second end 9112 and the fourth end 9122) that are connected with the connecting parts 921 and 922 of the base plate 92. The fixed span ds is usually shorter than the spacing interval between the connecting parts 921 and 922 of the base plate 92 (e.g., hooks). Consequently, in the process of assembling the scissors-type supporting element 91, the second end 9112 of the frame 911 and the connecting part 921 of the base plate 92 are firstly coupled with each other, and then a strong external force is applied to press the fourth end 9122 of the frame 912 into the connecting part 922 of the base plate 92. Alternatively, the fourth end 9122 of the frame 912 and the connecting part 922 of the base plate 92 are firstly coupled with each other, and then a strong external force is applied to press the second end 9112 of the frame 911 into the connecting part 921 of the base plate 92. If the spacing interval of the fixed span ds is too small, the process of applying the strong external force to press the end of the frame into the connecting part of the base plate may result in some drawbacks. For example, the difficulty of assembling the key structure is increased. Moreover, since the base plate 92 is made of the metallic material, the frames 911 and 912 of the supporting element 91 are readily scratched or damaged. Under this circumstance, the structural strength of the supporting element 91 is impaired.

For preventing the supporting element 91 from being scratched or damaged during the assembling process, the spacing interval of the fixed span ds between the frames 91 and 92 is slightly increased. The increase of the spacing interval of the fixed span ds can reduce the difficult of assembling the key structure. However, since the interference between the supporting element 91 and the connecting parts 921, 922 is reduced, the supporting element 91 is readily detached from the base plate 92.

Therefore, there is a need of providing an easily-assembled key structure with a specified structure design to prevent the supporting element from being scratched, damaged or detached.

SUMMARY OF THE INVENTION

The present invention provides a key structure an easily-assembled key structure with a specified structure design to prevent the supporting element from being scratched, damaged or detached.

In accordance with an aspect of the present invention, a key structure is provided. The key structure includes a keycap, a base plate and a supporting element. The base plate includes plural connecting parts. The supporting element is connected with the keycap and the base plate, so that the keycap is movable upwardly or downwardly relative to the base plate. The supporting element includes a first frame and a second frame. The first frame has a first end and a second end opposed to the first end. A rotating shaft is formed on an outer side of the first frame. The second frame has a third end and a fourth end opposed to the third end. An installation groove is formed in an inner side of the second frame and aligned with the rotating shaft. The installation groove includes an assembling hole part, a pivotal hole part and a stopping recess. The stopping recess is connected between the assembling hole part and the pivotal hole part. When the rotating shaft is inserted into the assembling hole part, a first span is formed between the second end of the first frame and the fourth end of the second frame. After the rotating shaft is transferred through the stopping recess and inserted into the pivotal hole part, a second span smaller than the first span is formed between the second end of the first frame and the fourth end of the second frame. Consequently, the second end of the first frame and the fourth end of the second frame are coupled with the corresponding connecting parts, and the first end of the first frame and the third end of the second frame are connected with the keycap.

In an embodiment, the assembling hole part has a semi-elliptical shape. Consequently, the rotating shaft is assembled with the assembling hole part in an interference fit manner.

In an embodiment, an inner side of the stopping recess is tapered in a direction from the assembling hole part to the pivotal hole part.

In an embodiment, a side of the rotating shaft facing the first end of the first frame has a first slant.

In an embodiment, a second slant is protruded from a bottom surface of the stopping recess, and the second slant is aligned with the first slant.

In an embodiment, the pivotal hole part is close to an upper edge of a lateral side of the second frame, and the assembling hole part is close to a lower edge of the lateral side of the second frame.

In an embodiment, the first end of the first frame includes a rotatable rod, and a pivotal part is formed on a bottom surface of the keycap. The rotatable rod is pivotally coupled to the pivotal part.

In an embodiment, the third end of the second frame includes a slidable rod, and a sliding coupling part is formed on a bottom surface of the keycap. The slidable rod is slidably coupled with the sliding coupling part.

In an embodiment, the second end of the first frame1 includes a first coupling rod, and the fourth end of the second frame includes a second coupling rod.

In an embodiment, the plural connecting parts include a first hook and a second hook. The first hook is aligned with the first coupling rod. The second hook is aligned with the second coupling rod.

In an embodiment, when the first span is formed between the second end of the first frame and the fourth end of the second frame, the first coupling rod and the second coupling rod are not contacted with the first hook and the second hook, respectively.

In an embodiment, when the first span is formed between the second end of the first frame and the fourth end of the second frame, the first coupling rod is not contacted with the first hook, or the second coupling rod is not contacted with the second hook.

In an embodiment, when the second span is formed between the second end of the first frame and the fourth end of the second frame, the first coupling rod and the second coupling rod are respectively contacted with the first hook and the second hook and respectively connected with the first hook and the second hook.

From the above descriptions, the present invention provides the key structure. In comparison the existing technologies, the key structure of the present invention is beneficial. During the process of assembling the key structure of the present invention, the first frame and the second frame of the supporting element are combined together to create a larger first span and a smaller second span sequentially. Due to the span adjustment, it is not necessary to apply a strong external force to press the frame of the supporting element into the connecting part of the base plate. Consequently, during the assembling process, the supporting element is not scratched or damaged by the metallic base plate.

Moreover, since the second span is smaller, the satisfactory interference between the supporting element and the connecting part of the base plate can be achieved. Consequently, the supporting element is not detached from the base plate. Moreover, since the movement of the rotating shaft of the first frame is limited by the installation groove, the first frame and the second frame are moved relative to each other in the linear direction. Due to this structural design, the key structure can be assembled by using automatic equipment. Consequently, the production efficiency of the key structure is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
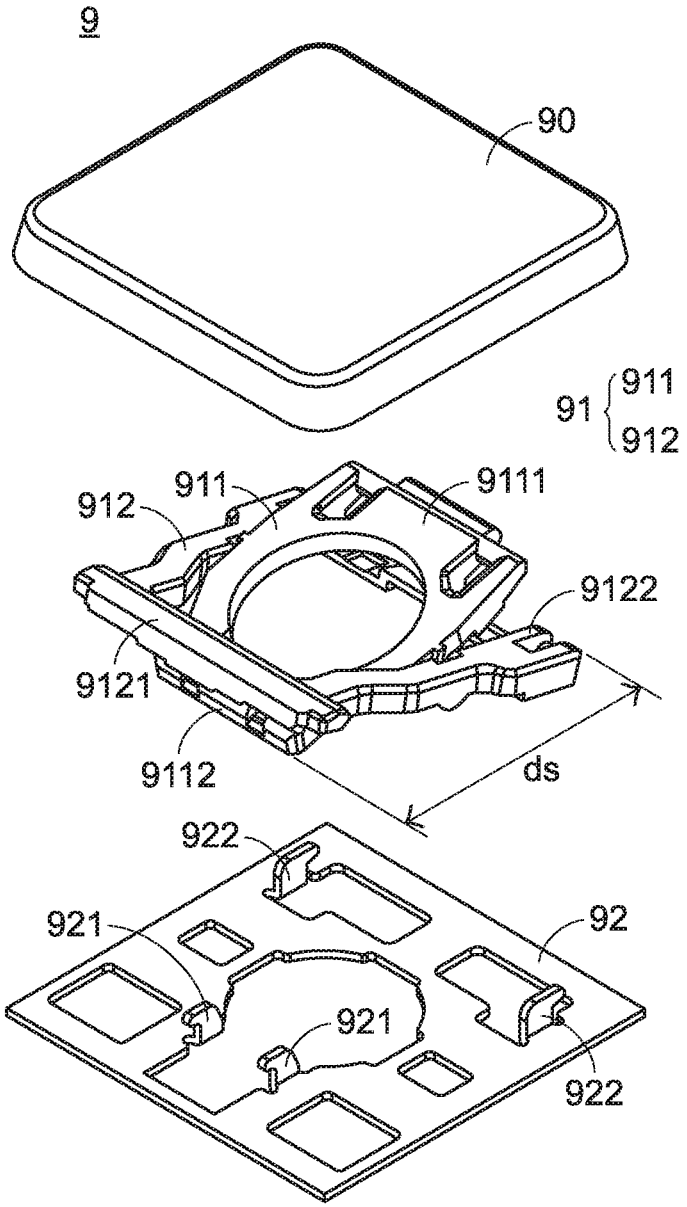
FIG.1 PRIOR ART
FIG. 1 is a schematic exploded view illustrating a conventional key structure.
Figure 2A:
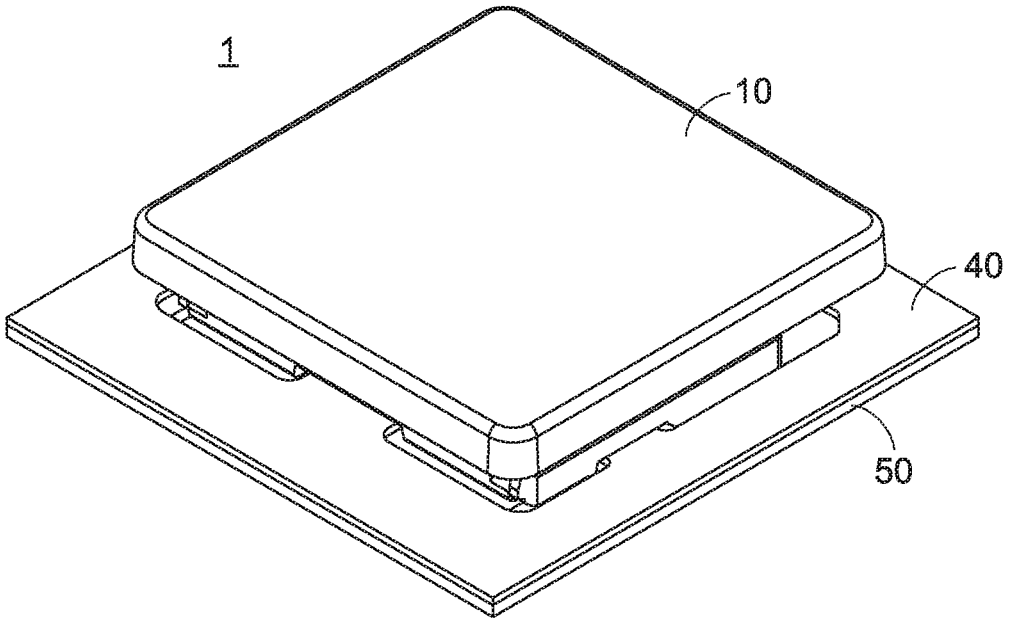
FIG. 2A is a schematic perspective view illustrating a key structure according to an embodiment of the present invention.
Figure 2B:
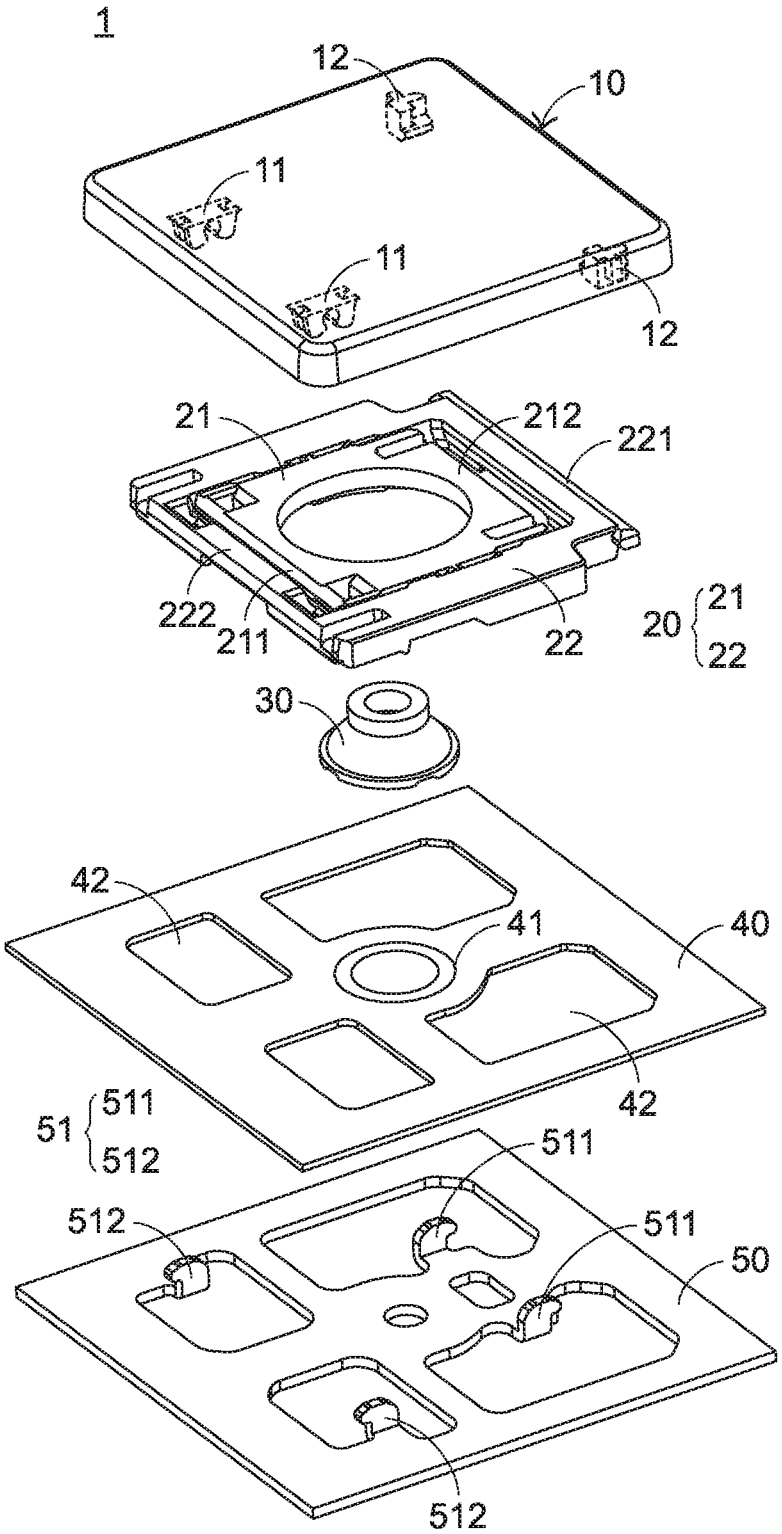
FIG. 2B is a schematic exploded view illustrating the key structure according to the embodiment of the present invention and taken along a viewpoint.
Figure 3:
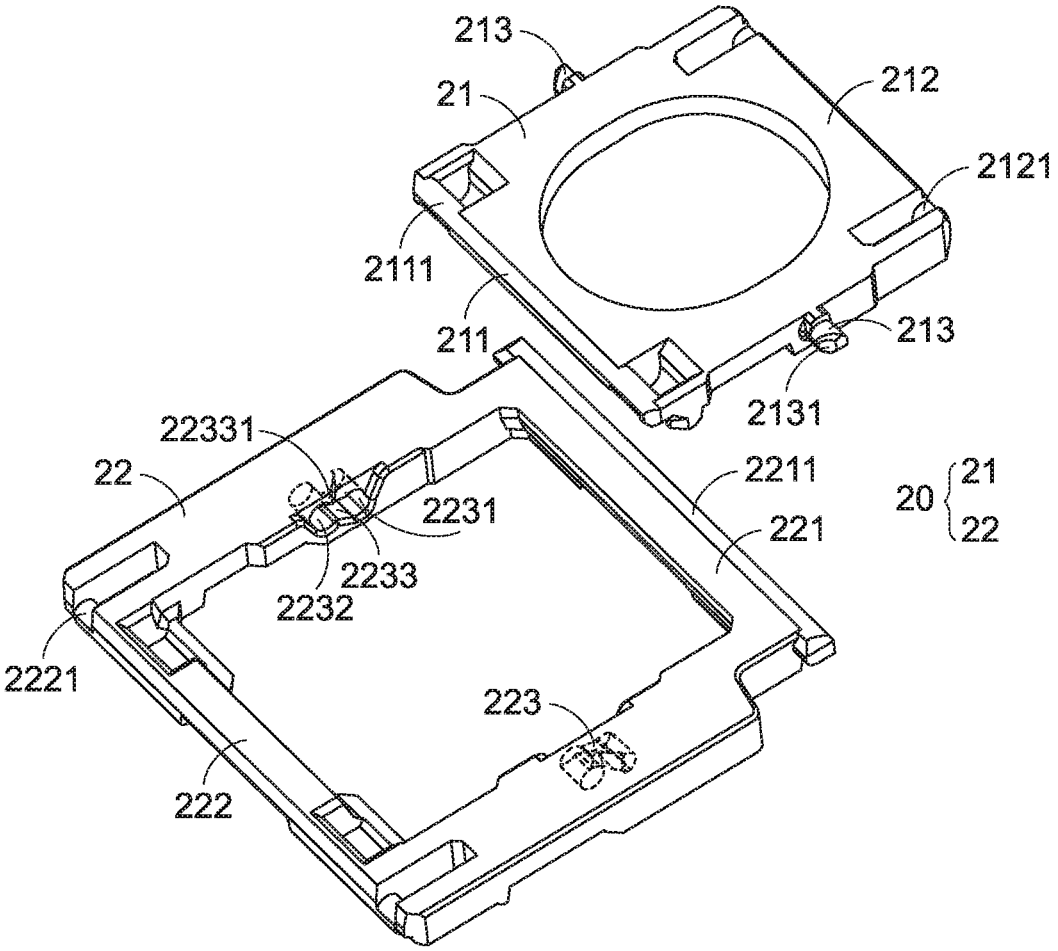
FIG. 3 is a schematic exploded view illustrating the supporting element of the key structure according to the embodiment of the present invention and taken along a viewpoint.

Please refer to FIGS. 2A, 2B and 3. FIG. 2A is a schematic perspective view illustrating a key structure according to an embodiment of the present invention. FIG. 2B is a schematic exploded view illustrating the key structure according to the embodiment of the present invention and taken along a viewpoint. FIG. 3 is a schematic exploded view illustrating the supporting element of the key structure according to the embodiment of the present invention and taken along a viewpoint. In an embodiment, the key structure 1 comprises a keycap 10, a supporting element 20, an elastic element 30, a membrane circuit board 40 and a base plate 50.

The supporting element 20 is connected with the keycap 10 and the base plate 50. Consequently, the keycap 10 can be moved upwardly or downwardly relative to the base plate 50. In an embodiment, the supporting element 20 comprises a first frame 21 and a second frame 22.

The first frame 21 has a first end 211 and a second end 212, which are opposed to each other. The first end 211 of the first frame 21 comprises a rotatable rod 2111. The second end 212 of the first frame 21 comprises a first coupling rod 2121. In addition, a rotating shaft 213 is formed on an outer side of the first frame 21. The rotating shaft 213 is in parallel with the rotatable rod 2111 and the first coupling rod 2121. In addition, the side of the rotating shaft 213 facing the first end 211 of the first frame 21 has a first slant 2131 (see FIG. 3).

The second frame 22 has a third end 221 and a fourth end 222, which are opposed to each other. The third end 221 of the second frame 22 comprises a slidable rod 2211. The fourth end 222 of the second frame 22 comprises a second coupling rod 2221. In addition, an installation groove 223 is formed in an inner side of the second frame 22 and aligned with the rotating shaft 213. The rotating shaft 213 is inserted into the assembling groove 223. In an embodiment, the installation groove 223 comprises an assembling hole part 2231, a pivotal hole part 2232 and a stopping recess 2233. The stopping recess 2233 is connected between the pivotal hole part 2232 and the stopping recess 2233. In addition, a second slant 22331 is protruded from a bottom surface of the stopping recess 2233. The second slant 22331 is aligned with the first slant 2131 of the rotating shaft 213.

A pivotal part 11 and a sliding coupling part 12 are formed on a bottom surface of the keycap 10. The rotatable rod 2111 of the first frame 21 is pivotally coupled to the pivotal part 11. Consequently, the rotatable rod 2111 of the first frame 21 is rotatable relative to the pivotal part 11. The slidable rod 2211 of the second frame 22 is slidably coupled with the sliding coupling part 12.

The base plate 50 comprises plural connecting parts 51. The connecting parts 51 are connected with the second end 212 of the first frame 21 and the fourth end 222 of the second frame 22. In an embodiment, the connecting parts 51 comprise a first hook 511 and a second frame 512. The first hook 511 is aligned with the first coupling rod 2121 at the first end 211 of the first frame 21. The second hook 512 is aligned with the second coupling rod 2221 at the fourth end 222 of the second frame 22.

The membrane circuit board 40 is located over the base plate 50. The membrane circuit board 40 comprises a membrane switch 41 and plural openings 42. The plural openings 42 are aligned with the corresponding connecting parts 51, respectively. The connecting parts 51 are penetrated through the corresponding openings 42.

The elastic element 30 is located over the membrane switch 41 and aligned with the keycap 10. In an embodiment, the elastic element 30 is enclosed by the supporting element 20. When the keycap 10 is pressed down and moved downwardly in response to an external force, the bottom surface of the keycap 10 pushes again the elastic element 30. Consequently, the elastic element 30 is subjected to deformation, and the membrane switch 41 is triggered to generate a key signal. When the keycap 10 is no longer pressed by the external force, the keycap 10 is moved upwardly and returned to its original position in response to an upward elastic restoring force that is provided by the elastic element 30.

Figure 4A:
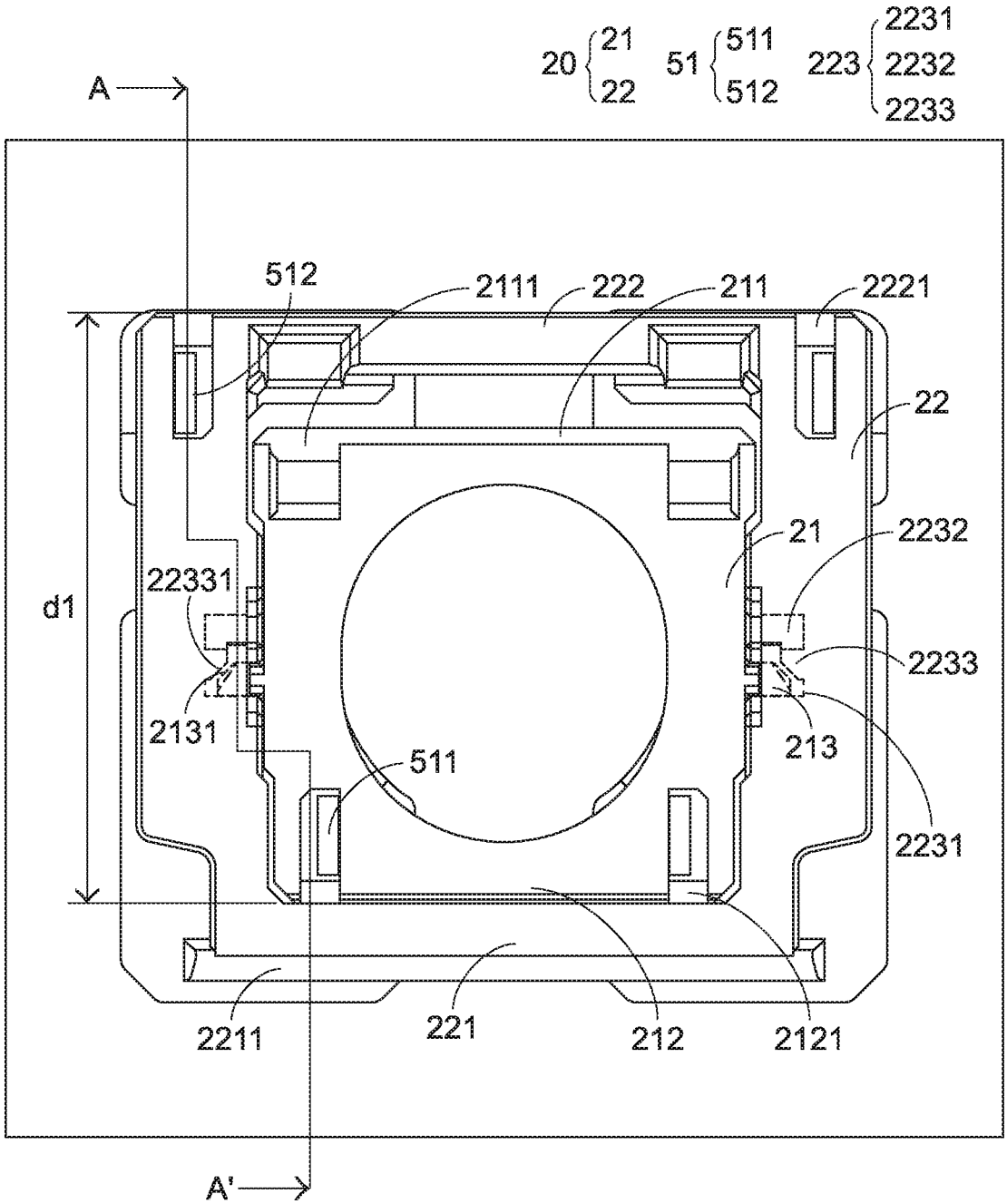
FIG. 4A is a schematic top view illustrating the installation of the supporting element of the key structure according to the embodiment of the present invention, in which the rotating shaft is inserted into the assembling hole part.
Figure 4B:
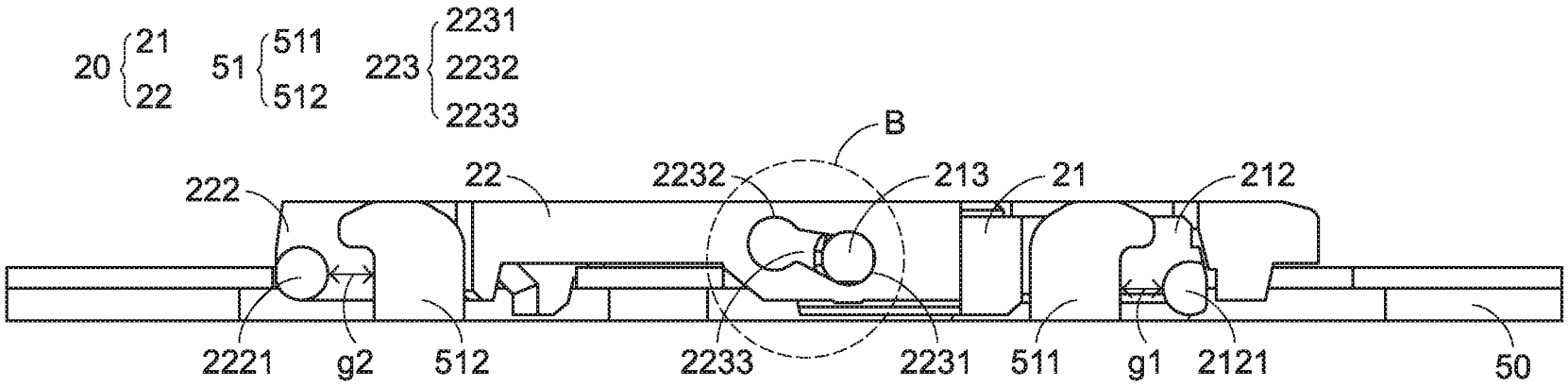
FIG. 4B is a schematic cross-sectional view illustrating the supporting element as shown in FIG. 4A and taken the line A-A'.
Figure 4C:
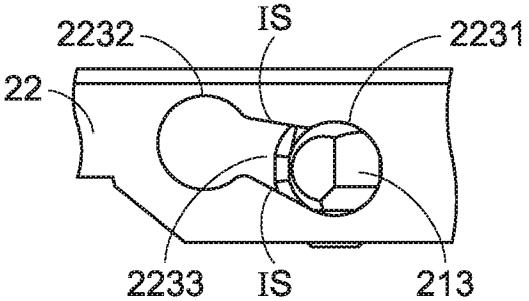
FIG. 4C is a schematic cross-sectional view illustrating the enlarged portion B of the supporting element as shown in FIG. 4B.
Figure 5A:
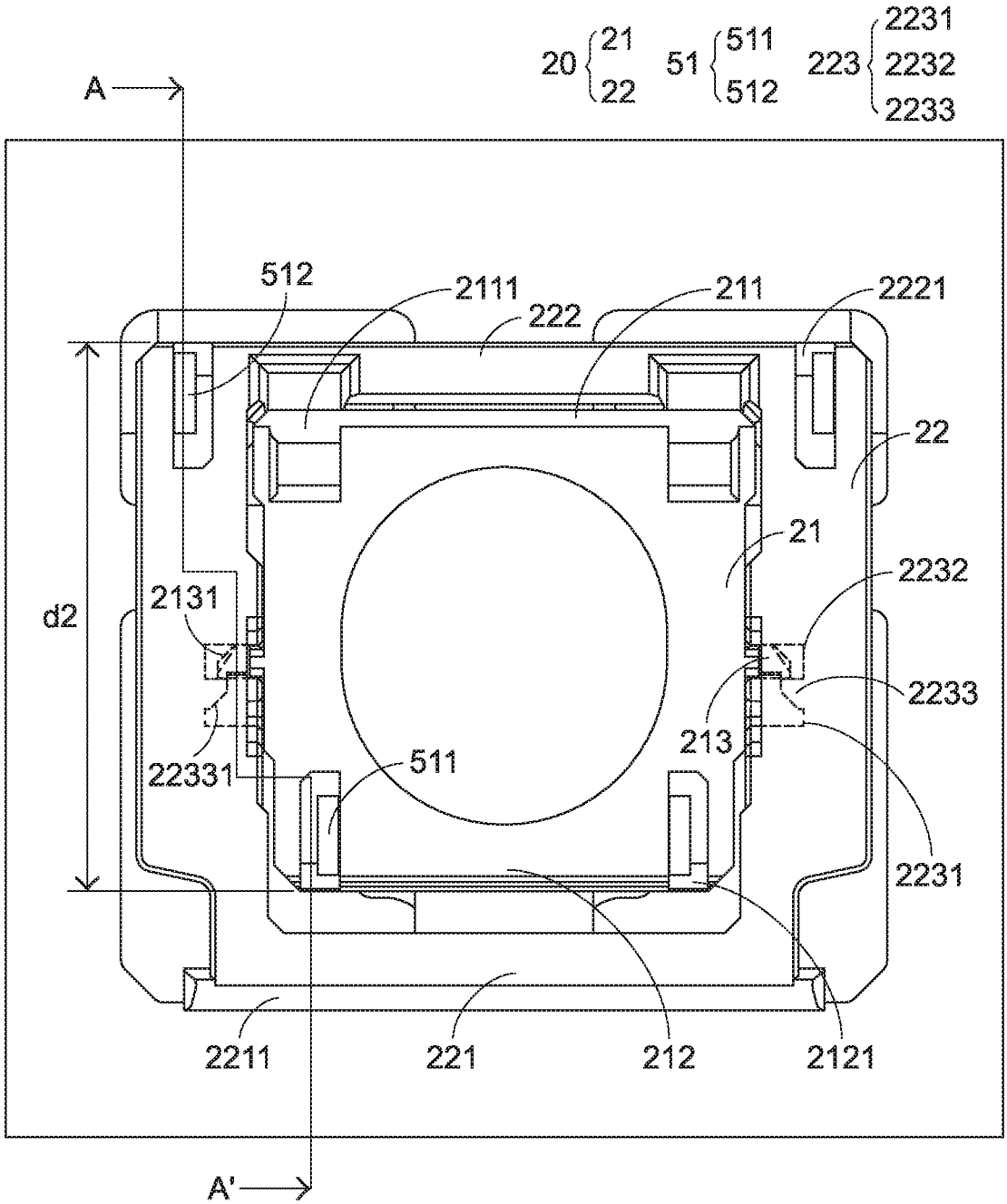
FIG. 5A is a schematic top view illustrating the installation of the supporting element of the key structure according to the embodiment of the present invention, in which the rotating shaft is inserted into the pivotal hole part.
Figure 5B:
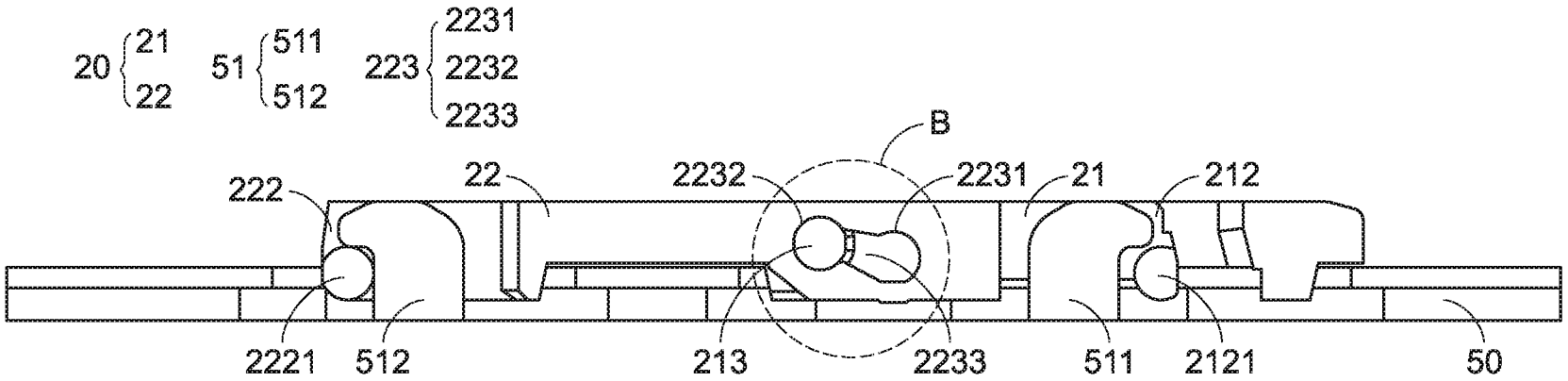
FIG. 5B is a schematic cross-sectional view illustrating the supporting element as shown in FIG. 5A and taken the line A-A'.
Figure 5C:
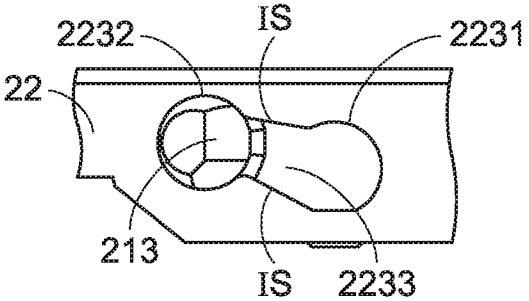
FIG. 5C is a schematic cross-sectional view illustrating the enlarged portion B of the supporting element as shown in FIG. 5B.

Please refer to FIGS. 4A, 4B, 4C, 5A, 5B and 5C. FIG. 4A is a schematic top view illustrating the installation of the supporting element of the key structure according to the embodiment of the present invention, in which the rotating shaft is inserted into the assembling hole part. FIG. 4B is a schematic cross-sectional view illustrating the supporting element as shown in FIG. 4A and taken the line A-A'. FIG. 4C is a schematic cross-sectional view illustrating the enlarged portion B of the supporting element as shown in FIG. 4B. FIG. 5A is a schematic top view illustrating the installation of the supporting element of the key structure according to the embodiment of the present invention, in which the rotating shaft is inserted into the pivotal hole part. FIG. 5B is a schematic cross-sectional view illustrating the supporting element as shown in FIG. 5A and taken the line A-A'. FIG. 5C is a schematic cross-sectional view illustrating the enlarged portion B of the supporting element as shown in FIG. 5B.

A process of assembling the key structure 1 will be described as follows.

Firstly, the rotating shaft 213 is inserted into the assembling hole part 2231. Meanwhile, as shown in FIG. 4A, there is a first span d1 between the second end 212 of the first frame 21 and the fourth end 222 of the second frame 22. Since the spacing interval of the first span d1 is larger than the spacing interval between the connecting parts 51 (i.e., the spacing interval between the first hook 511 and the second frame 512), the second end 212 of the first frame 21 and the fourth end 222 of the second frame 22 can be stably placed on the positions outside the connecting part 51. In this situation, there is a first gap g1 between the first coupling rod 2121 of the first frame 21 and the first hook 511 of the base plate 50, and there is a second gap g2 between the second coupling rod 2221 of the second frame 22 and the second hook 512 of the base plate 50 (see FIG. 4B). In other words, the first coupling rod 2121 of the first frame 21 and the second coupling rod 2221 of the second frame 22 are not contacted with the first hook 511 and the second hook 512, respectively.

In the above embodiment, the first coupling rod 2121 and the second coupling rod 2221 are separated from the first hook 511 and the second hook 512 by the first gap g1 and the second gap g2, respectively. It is noted that numerous modifications may be made while retaining the teachings of the present invention. For example, in another embodiment, the first coupling rod 2121 and the first hook 511 are contacted with each other, and the gap between the second coupling rod 2221 and the second hook 512 is increased. In a further embodiment, the second coupling rod 2221 and the second hook 512 are contacted with each other, and the gap between the first coupling rod 2121 and the first hook 511 is increased.

Please refer to FIG. 4C. The assembling hole part 2231 is close to the lower edge of the lateral side of the second frame 22, and the pivotal hole part 2232 is close to the upper edge of the lateral side of the second frame 22. The inner side IS of the stopping recess 2233 is tapered in the direction from the assembling hole part 2231 to the pivotal hole part 2232. Consequently, the resistance of moving the rotating shaft 213 from the assembling hole part 2231 to the pivotal hole part 2232 is smaller, and the resistance of moving the rotating shaft 213 from the pivotal hole part 2232 to the assembling hole part 2231 is larger.

In an embodiment, the assembling hole part 2231 has a semi-elliptical shape. Consequently, the rotating shaft 213 is assembled with the assembling hole part 2231 in an interference fit manner. Since a radial pressure is applied to the rotating shaft 213 by the assembling hole part 2231 and a friction force between the assembling hole part 2231 and the rotating shaft 213 is generated, the rotating shaft 213 cannot be rotated. Consequently, while the rotating shaft 213 is inserted into the assembling hole part 2231, the switching action between the first frame 21 and the second frame 22 can be limited. In other words, the possibility of causing the damage of the base plate 50 or the connecting part 51 in response to the impact of the switching action will be minimized. Moreover, due to this structural design, the first coupling rod 2121 of the first frame 21 and the second coupling rod 2221 of the second frame 22 can be stably placed on the positions outside the first hook 511 and the second hook 512. Consequently, the assembling efficiency of the key structure 1 is enhanced.

Please refer to FIG. 5A again. Then, the first frame 21 is pushed. Due to the cooperation of the first slant 2131 of the rotating shaft 213 and the second slant 22331 of the stopping recess 2233, the rotating shaft 213 is moved along the second slant 22331 and transferred through the stopping recess 2233. Then, the rotating shaft 213 is inserted into the pivotal hole part 2232. Consequently, the first frame 21 and the second frame 22 can be swung relative to each other. In this situation, there is a second span d2 between the second end 212 of the first frame 21 and the fourth end 222 of the second frame 22. The second span d2 is smaller than the first span d1.

In case that there is the second span d2 between the second end 212 of the first frame 21 and the fourth end 222 of the second frame 22, the first coupling rod 2121 and the second coupling rod 2221 are contacted with the first hook 511 and the second hook 512, respectively. In other words, as shown in FIG. 5B, the first coupling rod 2121 and the second coupling rod 2221 are connected with the first hook 511 and the second hook 512, respectively. Since the spacing interval of the second span d2 is smaller, the interference between the supporting element 20 and the connecting part 51 of the base plate 50 is good enough. Consequently, the supporting element 20 will not be detached from the base plate 50. Especially, during the process of fabricating the key structure 1, the distance between the pivotal hole part 2232 and the assembling hole part 2231 can be adjusted according to the practical requirements. Consequently, the first span d1 and the second span d2 between the first frame 21 and the second frame 22 can be adjusted. In this way, the supporting element 20 can be applied to various base plates 50 with different connecting parts 51 corresponding to different gaps.

Please refer to FIG. 5C. As mentioned above, the inner side IS of the stopping recess 2233 is tapered in the direction from the assembling hole part 2231 to the pivotal hole part 2232, and the resistance of moving the rotating shaft 213 from the pivotal hole part 2232 to the assembling hole part 2231 is larger. After the rotating shaft 213 is transferred through the stopping recess 2233, the inner side IS of the stopping recess 2233 can limit the movement of the rotating shaft 213 in the leftward or rightward direction. In this way, the rotating shaft 213 inserted into the pivotal hole part 2232 will not be returned to the position of the assembling hole part 2231 through the stopping recess 2233. On the other hand, since the second slant 22331 is protruded from the bottom surface of the stopping recess 2233, the second slant 22331 also has the function of limiting the movement of the rotating shaft 213 in the leftward or rightward direction. It is noted that numerous modifications may be made while retaining the teachings of the present invention. For example, in case that either the inner side IS of the stopping recess 2233 is tapered or the second slant 22331 is protruded from the bottom surface of the stopping recess 2233, the function of limiting the movement of the rotating shaft 213 in the leftward or rightward direction can also be achieved.

As mentioned above, the assembling hole part 2231 is close to the lower edge of the lateral side of the second frame 22, and the pivotal hole part 2232 is close to the upper edge of the lateral side of the second frame 22. In other words, the key structure is designed to have the angle and height difference. Consequently, while the supporting element 20 is pulled out, the rotating shaft 213 can not be returned to the position of the assembling hole part 2231 through the stopping recess 2233.

In comparison the existing technologies, the key structure of the present invention is beneficial. During the process of assembling the key structure of the present invention, the first frame and the second frame of the supporting element are combined together to create a larger first span and a smaller second span sequentially. Due to the span adjustment, it is not necessary to apply a strong external force to press the frame of the supporting element into the connecting part of the base plate. Consequently, during the assembling process, the supporting element is not scratched or damaged by the metallic base plate.

Moreover, since the second span is smaller, the satisfactory interference between the supporting element and the connecting part of the base plate can be achieved. Consequently, the supporting element is not detached from the base plate. Moreover, since the movement of the rotating shaft of the first frame is limited by the installation groove, the first frame and the second frame are moved relative to each other in the linear direction. Due to this structural design, the key structure can be assembled by using automatic equipment. Consequently, the production efficiency of the key structure is enhanced. In other words, the key structure of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap;

a base plate comprising plural connecting parts; and a supporting element connected with the keycap and the base plate, so that the keycap is movable upwardly or downwardly relative to the base plate, wherein the supporting element comprises:

a first frame having a first end and a second end opposed to the first end, wherein a rotating shaft is formed on an outer side of the first frame; and a second frame having a third end and a fourth end opposed to the third end, wherein an installation groove is formed in an inner side of the second frame and aligned with the rotating shaft, wherein the installation groove comprises an assembling hole part, a pivotal hole part and a stopping recess, and the stopping recess is connected between the assembling hole part and the pivotal hole part, wherein when the rotating shaft is inserted into the assembling hole part, a first span is formed between the second end of the first frame and the fourth end of the second frame, wherein after the rotating shaft is transferred through the stopping recess and inserted into the pivotal hole part, a second span smaller than the first span is formed between the second end of the first frame and the fourth end of the second frame, so that the second end of the first frame and the fourth end of the second frame are coupled with the corresponding connecting parts and the first end of the first frame and the third end of the second frame are connected with the keycap.

2. The key structure according to claim 1, wherein the assembling hole part has a semi-elliptical shape, so that the rotating shaft is assembled with the assembling hole part in an interference fit manner.

3. The key structure according to claim 1, wherein an inner side of the stopping recess is tapered in a direction from the assembling hole part to the pivotal hole part.

4. The key structure according to claim 1, wherein a side of the rotating shaft facing the first end of the first frame has a first slant.

5. The key structure according to claim 4, wherein a second slant is protruded from a bottom surface of the stopping recess, and the second slant is aligned with the first slant.

6. The key structure according to claim 1, wherein the pivotal hole part is close to an upper edge of a lateral side of the second frame, and the assembling hole part is close to a lower edge of the lateral side of the second frame.

7. The key structure according to claim 1, wherein the first end of the first frame comprises a rotatable rod, and a pivotal part is formed on a bottom surface of the keycap, wherein the rotatable rod is pivotally coupled to the pivotal part.

8. The key structure according to claim 1, wherein the third end of the second frame comprises a slidable rod, and a sliding coupling part is formed on a bottom surface of the keycap, wherein the slidable rod is slidably coupled with the sliding coupling part.

9. The key structure according to claim 1, wherein the second end of the first frame comprises a first coupling rod, and the fourth end of the second frame comprises a second coupling rod.

10. The key structure according to claim 9, wherein the plural connecting parts include a first hook and a second hook, wherein the first hook is aligned with the first coupling rod, and the second hook is aligned with the second coupling rod.

11. The key structure according to claim 10, wherein when the first span is formed between the second end of the first frame and the fourth end of the second frame, the first coupling rod and the second coupling rod are not contacted with the first hook and the second hook, respectively.

12. The key structure according to claim 10, wherein when the first span is formed between the second end of the first frame and the fourth end of the second frame, the first coupling rod is not contacted with the first hook, or the second coupling rod is not contacted with the second hook.

13. The key structure according to claim 10, wherein when the second span is formed between the second end of the first frame and the fourth end of the second frame, the first coupling rod and the second coupling rod are respectively connected with the first hook and the second hook.

* * * * *